US008079826B2

(12) United States Patent
Shulver et al.

(10) Patent No.: US 8,079,826 B2
(45) Date of Patent: Dec. 20, 2011

(54) VANE PUMP WITH SUBSTANTIALLY CONSTANT REGULATED OUTPUT

(75) Inventors: David R. Shulver, Richmond Hill (CA); Cezar Tanasuca, Richmond Hill (CA); Matthew Williamson, Richmond Hill (CA)

(73) Assignee: Magna Powertrain Inc., Concord (CA)

( * ) Notice: Subject to any disclaimer, the term of this patent is extended or adjusted under 35 U.S.C. 154(b) by 1010 days.

(21) Appl. No.: 11/968,679

(22) Filed: Jan. 3, 2008

(65) Prior Publication Data

US 2008/0175724 A1 Jul. 24, 2008

(51) Int. Cl.
*F04B 49/00* (2006.01)

(52) U.S. Cl. ..... 417/220; 418/26; 418/27; 418/30

(58) Field of Classification Search ..... 417/213, 417/218, 220; 418/24, 26, 27, 30, 28–29
See application file for complete search history.

(56) References Cited

U.S. PATENT DOCUMENTS

| | | | | |
|---|---|---|---|---|
| 2,669,189 | A * | 2/1954 | De Lancey et al. | 418/27 |
| 2,716,946 | A | 9/1955 | Hardy | |
| 3,107,628 | A | 10/1963 | Rynders et al. | |
| 4,342,545 | A | 8/1982 | Schuster | |
| 4,437,819 | A * | 3/1984 | Merz | 418/26 |
| 5,090,881 | A * | 2/1992 | Suzuki et al. | 418/26 |
| 5,484,271 | A | 1/1996 | Stich | |
| 5,690,479 | A | 11/1997 | Lehmann et al. | |
| 5,752,815 | A * | 5/1998 | Muller | 418/26 |
| 6,457,946 | B2 | 10/2002 | Gretzschel et al. | |
| 6,470,992 | B2 | 10/2002 | Nissen et al. | |
| 6,558,132 | B2 | 5/2003 | Hanggi | |
| 6,688,862 | B2 | 2/2004 | Jeronymo et al. | |
| 2002/0172610 | A1 * | 11/2002 | Jeronymo et al. | 418/30 |
| 2003/0059313 | A1 * | 3/2003 | Hanggi | 417/220 |

* cited by examiner

*Primary Examiner* — Charles Freay
*Assistant Examiner* — Todd D Jacobs
(74) *Attorney, Agent, or Firm* — Harness, Dickey & Pierce, P.L.C.

(57) ABSTRACT

A variable displacement vane pump provides a substantially constant output pressure in its regulated operation region. A longitudinal axis of the control spring is inclined, with respect to a plane through the rotational axis of a pivot and a contact point between the control ring and the control spring. The inclination reduces the length of the moment arm between the spring and the pivot when the control ring of the pump is moved from the maximum displacement position to the minimum displacement position. The reduced length moment arm offsets the increase in the moment produced by compression of the control spring is offset to achieve a substantially constant output pressure. The control spring is compressed a reduced amount during pump operation to minimize the change in output force exerted by the control spring as the control ring moves between positions.

7 Claims, 4 Drawing Sheets

VANE PUMP WITH SUBSTANTIALLY CONSTANT REGULATED OUTPUT

FIELD OF THE INVENTION

The present invention relates to a variable displacement vane pump. More specifically, the present invention relates to a variable displacement vane pump which provides a substantially constant output in the regulated portion of its output characteristic.

BACKGROUND OF THE INVENTION

Variable displacement vane pumps are well known and are used in a variety of systems. One use for such pumps which is becoming increasingly common is as lubrication oil pumps on internal combustion engines. Lubrication oil pumps in internal combustion engines operate over a wide range of speeds, as the engine operating speed changes, resulting in the output volume and the output pressure (as the output of these pumps is generally supplied to a lubrication system which can be approximately modeled as a fixed size orifice) of the pumps changing with their operating speed.

Generally, an internal combustion engine requires the lubrication oil pressure to increase with engine operating speed from a minimum necessary level at the lowest operating speed of the engine to a maximum desired pressure level, at a given higher operating speed of the engine. The engine's oil pressure requirements do not increase beyond the maximum desired pressure level at any other operating conditions.

As the maximum desired oil pressure level is output from the pump under normal temperature conditions at engine operating speeds well below the maximum engine operating speed, the lubrication oil pump will provide an oversupply of lubrication oil over a significant portion of the engine operating speed and temperature ranges unless its displacement is decreased once the maximum desired oil pressure has been reached. The oversupply of lubricating oil is undesired as it wastes energy, reducing fuel efficiency of the engine, and in some applications as the oversupply results in an overpressure which can damage the engine and/or other components of the engine system.

Accordingly, variable displacement vane pumps include a moveable control ring which allows the displacement capacity per revolution of the pump to be changed. Typically a control spring biases the control ring to the position of maximum displacement and a feedback mechanism, such as a control piston connected to a supply of pressurized oil from the pump, acts to move the control ring towards the position of minimum displacement as the operating speed of the pump increases in order to regulate oil pressure to a specified level.

At engine start up, the feedback mechanism cannot overcome the biasing force of the control spring and the control ring will be in the maximum displacement position to ensure that the pump supplies lubricating oil at the minimum necessary pressure. As the operating speed of the pump increases, the output pressure of the pump increases and the feedback mechanism begins to counter the biasing force of the control spring, reducing the displacement of the pump by moving the control ring towards the minimum displacement position and thus preventing undesired overpressure conditions in the output of the pump.

Ideally, once the output of the pump reaches the maximum desired pressure level for the engine (i.e. the regulated operating region), further increases in the operating speed of the engine and pump result in corresponding decreases in the displacement of the pump such that the output pressure of the pump does not exceed the maximum desired pressure level. However in actual practice, as the above-described control spring is compressed by the feedback mechanism, the force exerted on the control ring by the spring increases for further movement of the control ring toward the minimum displacement position. Thus the displacement of the pump is not decreased sufficiently to completely counter the increased operating speed and the output pressure of the pump continues to increase, albeit at a significantly reduced rate, in the regulated operating region.

It is desired to have a variable displacement vane pump which provides a substantially constant output, independent of operating speed increases, when the pump is in its regulated operating region.

SUMMARY OF THE INVENTION

It is an object of the present invention to provide a novel variable displacement vane pump which obviates or mitigates at least one disadvantage of the prior art.

According to a first aspect of the present invention, there is provided a variable displacement vane pump, comprising: a control ring pivotable between a first position wherein the pump has a maximum displacement and a second position wherein the pump has a minimum displacement; a feedback mechanism responsive to the output pressure of the pump to move the control ring from the first position towards the second position in response to increases in the output pressure of the pump; and a control spring biasing the control ring towards the first position, the longitudinal axis of the control spring being inclined at an angle of from about ten degrees to about eighty degrees with respect to a plane passing through the rotational axis about which the control ring pivots and the contact point between the control ring and the control spring.

Preferably, the control spring is at an angle from about twenty-five degrees to about sixty-five degrees. More preferably, the angle can range from about thirty-five degrees to about fifty-five degrees. Still more preferably, the angle can range from about forty degrees to about fifty degrees.

According to another aspect of the present invention, there is provided a variable displacement vane pump operable to provide a substantially constant output, independent of pump operating speed increases, when the pump is in its regulated operating region, the pump comprising: a control ring pivotable between a first position wherein the pump has a maximum displacement and a second position wherein the pump has a minimum displacement; a feedback mechanism responsive to the output pressure of the pump to move the control ring from the first position towards the second position in response to increases in the output pressure of the pump; and a control spring biasing the control ring towards the first position, wherein the control spring is oriented with respect to a plane, extending through the rotational axis about which the control ring pivots and the contact point between the control ring and the spring, such that the moment arm of the control spring force about the point where the control ring pivots decreases as the control ring pivots towards the second position.

Preferably, the orientation of the control spring also reduces the amount by which the control spring is compressed when the control ring moves from the first position to the second position.

The present invention provides a variable displacement vane pump which is able to achieve a substantially constant output pressure in its regulated operation region. The longitudinal axis of the control spring of the pump is inclined, with respect to a plane through the rotational axis of the pivot and the contact point between the control ring and the control spring, and this inclination results in a reduction in the length of the moment arm between the spring and the pivot when the control ring of the pump is moved from the maximum displacement position to the minimum displacement position. By reducing the length of this moment arm, the increase in the moment produced by compression of the control spring is offset, resulting in a substantially constant output pressure in the regulated operating range of the pump. The inclination further results in a reduction in the amount by which the control spring is compressed when the control ring moves from the first position to the second position. This reduction in the change in length of the control spring results in a corresponding reduction in the amount by which the spring force exerted by the control spring increases as the control ring moves from the first position to the second position.

BRIEF DESCRIPTION OF THE DRAWINGS

Preferred embodiments of the present invention will now be described, by way of example only, with reference to the attached Figures, wherein.

DETAILED DESCRIPTION OF THE INVENTION

Figure 1:
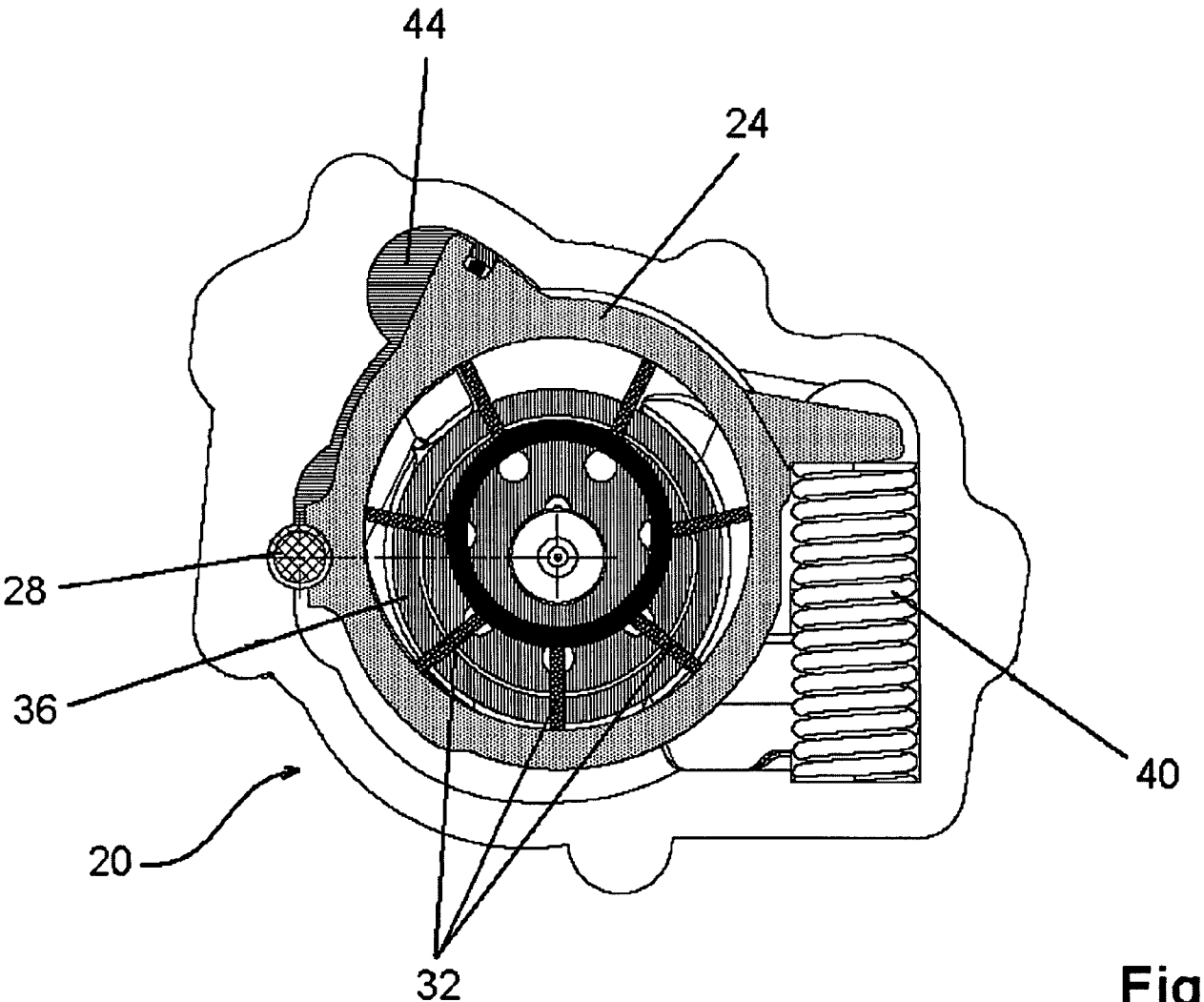
Fig. 1 (prior art)
FIG. 1 shows a cross section through a prior art variable displacement vane pump.

A prior art variable displacement vane pump is indicated generally at 20 in FIG. 1. Pump 20 includes a control ring 24, which pivots about a pivot pin 28 to alter the degree of eccentricity of the vanes 32 about the rotor 36 of pump 20 to change the displacement of pump 20.

Control ring 24 is biased to the maximum displacement position (as shown in FIG. 1) by a control spring 40 and a feedback mechanism, in the form of a control chamber 44, generates a force to counter the biasing force of control spring 40 as the pressure of the output of pump 20 increases. Specifically, in this example, control chamber 44 is supplied with pressurized fluid from the output port of pump 20 and that pressurized fluid creates a force on the portion of control ring 24 within chamber 44 and that force biases control ring 24, against control spring 40 towards the minimum displacement position for control ring 24. As will be understood by those of skill in the art, control chamber 44 can be supplied with pressurized fluid from any suitable source, including sources other than pump 20 if it is desired to control pump 20 independent of its output.

Figure 2:
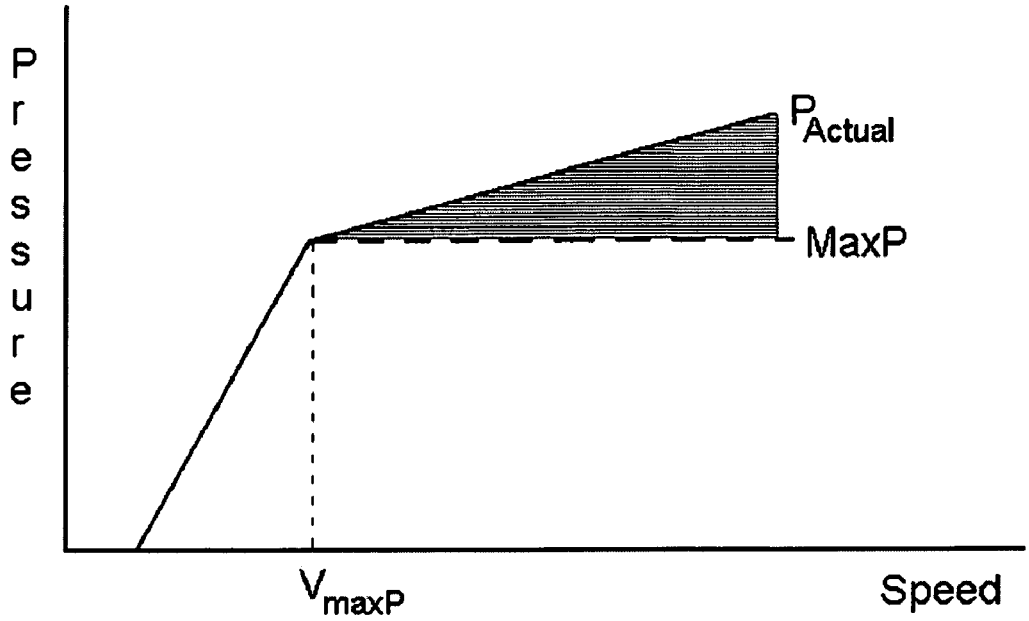
Fig. 2 (prior art)
FIG. 2 shows a plot of the output pressure of the prior art pump of FIG. 1 versus the operating speed.

FIG. 2 shows a plot of the output pressure of pump 20 versus its operating speed. In the plot, the maximum necessary pressure for the internal combustion engine supplied by pump 20 is indicated by the dashed line MaxP and this pressure is reached at an operating speed of $V_{maxP}$ at which point the force in control chamber 44 exerted on control ring 24 begins to exceed the force exerted on control ring 24 by control spring 40 and control ring 24 begins to move toward the minimum displacement position. The operation of pump 20 above $V_{maxP}$ is referred to herein as operation in the regulated operating region.

As can be seen, the actual output pressure, $P_{Actual}$, of pump 20 continues to increase with speed increases in the regulated operating region, after $V_{maxP}$ has been reached, albeit at a lower rate than before, as the force generated by control spring 40 increases as control spring 40 is compressed by movement of control ring 24 towards the minimum displacement position.

Specifically, as is well known, the moment about pivot pin 28 from control spring 40 is the product of the force applied to control ring 24 by control spring 40 and the moment arm. The moment arm is the distance between the center of pivot pin 28 and a line parallel to the longitudinal axis of control spring 40 passing through the contact point of control spring 40 and control ring 24) or, when represented in equation form $M=A*F_S$.

The force, $F_S$ produced by a spring is equal to $k_s$ times $\Delta L$, or $F_S=k_s*\Delta L$, where $k_s$ is the spring constant and $\Delta L$ is the change in length of the spring. Therefore, in the prior art design, as the force in control chamber 44 increases to further move control ring 24 against control spring 40, the force exerted by control spring 40 on control ring 24 increases, countering, to some extent, the force created in chamber 44. Further, the moment arm A tends to increase, due the geometry of control ring 24, pivot pin 28 and control spring 40, to further increase the moment M as control ring 24 moves towards the minimum displacement position.

Thus, the output pressure of pump 20 exceeds the output pressure requirements in the regulated operating region and the hatched area of FIG. 2 represents the energy loss in pump 20 due to this surplus output pressure.

Figure 3:
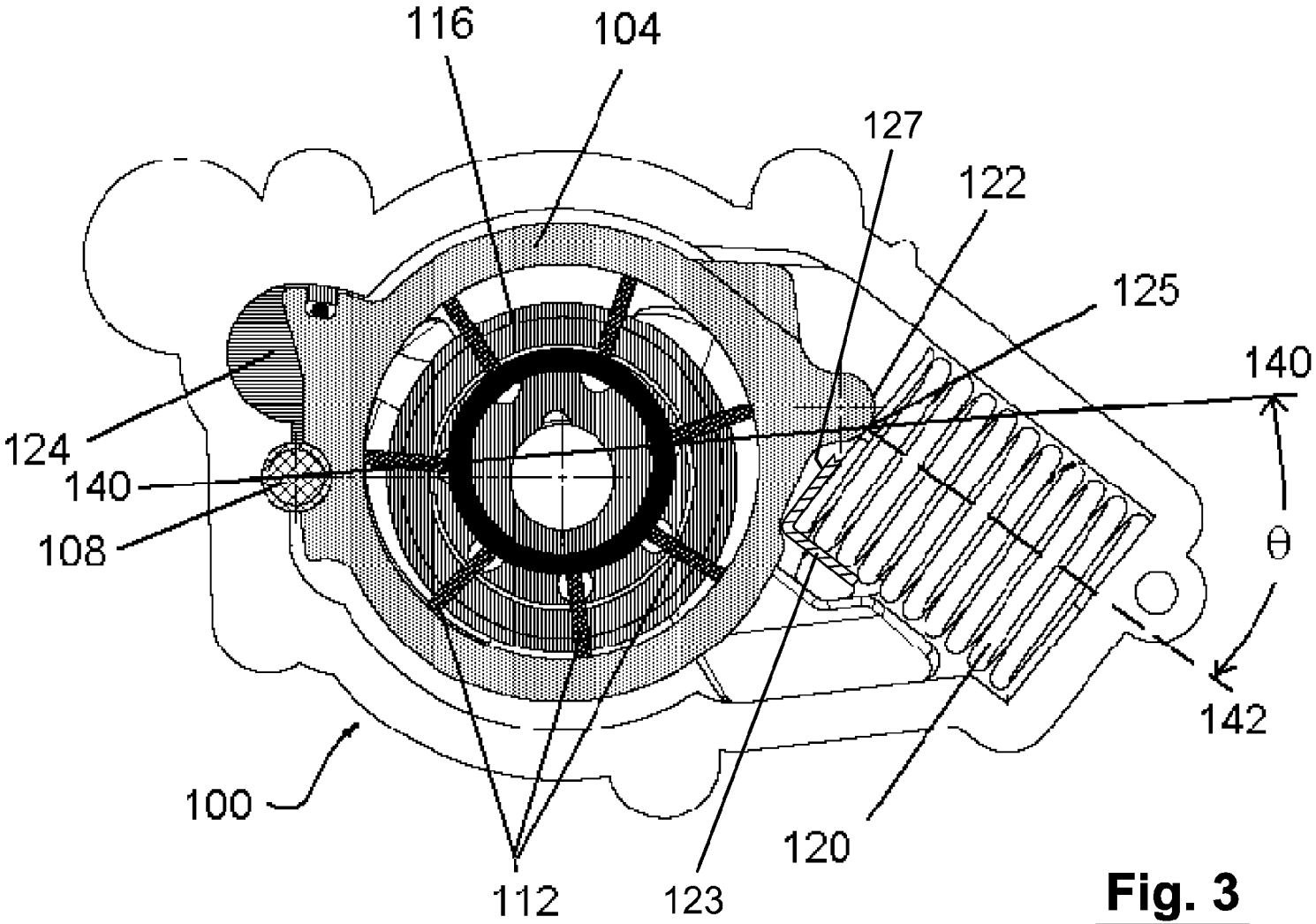
FIG. 3 shows a cross section through a variable displacement vane pump in accordance with the present invention.

FIG. 3 shows a variable displacement vane pump 100 in accordance with the present invention. Pump 100 includes a control ring 104, which pivots about a pivot pin 108 to alter the degree of eccentricity of the vanes 112 about the rotor 116 of pump 100 to change the displacement of pump 100. While the embodiment of FIG. 3 shows a pivot pin 108, it should be apparent to those of skill in the art that the present invention is not limited to pumps with pivot pins and any other structure, such as a boss, about which control ring 104 can pivot can be usefully employed as an alternative.

Control ring 104 is biased to the maximum displacement position (as shown in FIG. 3) by a control spring 120. Control spring 120 acts against a spring engaging protrusion 122 on control ring 104. As can be seen in FIG. 3, the surface of protrusion 122 which abuts control spring 120 is curved such that protrusion 122 can rotate and/or slide against the end of control spring 120 as control ring 104 is moved towards and away from the maximum displacement position. It is also contemplated that a spring cap 123 (shown in fragmentary section) can be inserted over the end of control spring 120 and that the spring cap can have the desired shape or contour to allow protrusion 122 to rotate and/or slide, as desired, against a surface 127 of the spring cap as control ring 104 is pivoted. As will also be apparent to those of skill in the art, either of protrusion 122 or the spring cap can be equipped with a bearing to facilitate the movement of protrusion 122 against control spring 120.

It is also contemplated that other methods for appropriately connecting control spring 120 and control ring 104 will occur to those of skill in the art and such other methods are intended to be within the scope of the present invention. For example, control ring 104 can omit protrusion 122 and can instead include a feature such as a groove or rib which a spring cap on control spring 120 will engage.

A feedback mechanism, in the form of a control chamber 124, generates a force to counter the biasing force of control spring 120 as the pressure of the output of pump 100 increases. Specifically, in this example, control chamber 124 is supplied with pressurized fluid from the output port of pump 100 and that pressurized fluid creates a force on the portion of control ring 104 within chamber 44 and that force biases control ring 104, against control spring 120 towards the minimum displacement position for control ring 104. As will be understood by those of skill in the art, control chamber 124 can be supplied with pressurized fluid from any suitable source, including sources other than pump 100 if it is desired to control pump 100 independent of its output.

As will be apparent to those of skill in the art, in many regards pump 100 of the present invention is similar to prior art pump 20, with the principle difference being the geometric arrangement and positioning of control spring 120 with respect to pivot pin 108 and control ring 104.

Specifically, the present inventors have determined that the moment M, created about pivot pin 108 by control spring 120, can be kept relatively constant during movement of control ring 104 if the geometry of pivot pin 108, control ring 104 and control spring 120 is carefully arranged. By keeping moment M relatively constant, the output of pump 100 in the regulated operating region can be kept substantially constant.

In the present invention, unlike control spring 40 of pump 20, control spring 120 is positioned with its longitudinal axis 142 at a non perpendicular angle θ with respect to an imaginary plane 140 extending through the rotational axis of pivot pin 108 and the contact point 125 at which control spring 120 contacts protrusion 122. By orienting the longitudinal axis of control spring 120 at such an angle, the present inventors have determined that moment arm A can be reduced as control ring 104 is moved toward the minimum displacement position. Further, the present inventors have determined that the change in length (ΔL) of control spring 120 is less than the change in length (ΔL) for control spring 40 which occurs with prior art pump 20.

While the increase of $F_S$ is inevitable with the change in the length (ΔL) of control spring 120 as control ring 120 moves toward the minimum displacement position, in pump 100 the moment M can be maintained as substantially constant as A decreases with the movement and the amount of compression (ΔL) of control spring 120 is decreased as well.

Figure 4:
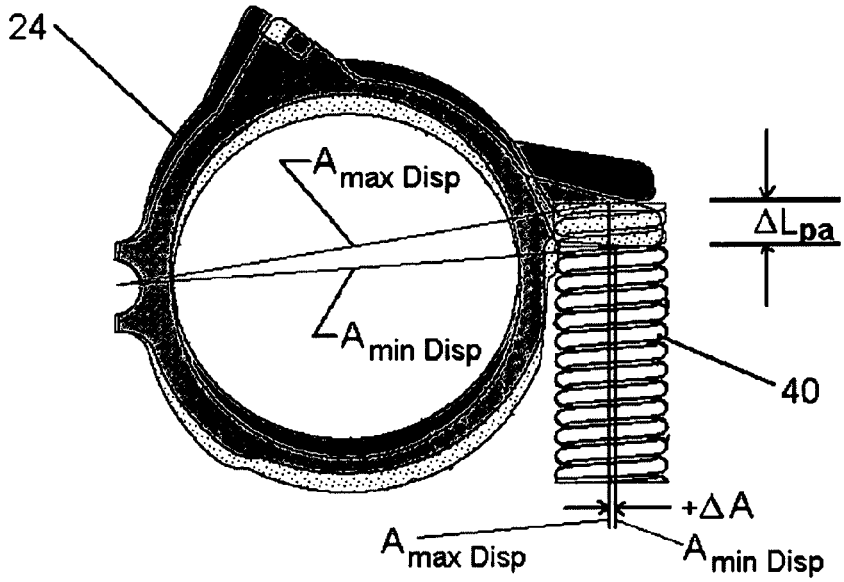
Fig. 4 (prior art)
FIG. 4 a graphical representation of the change in length of the moment arm and the change in length of the control spring between the maximum displacement position and the minimum displacement position of the prior art pump of FIG. 1.
Figure 5:
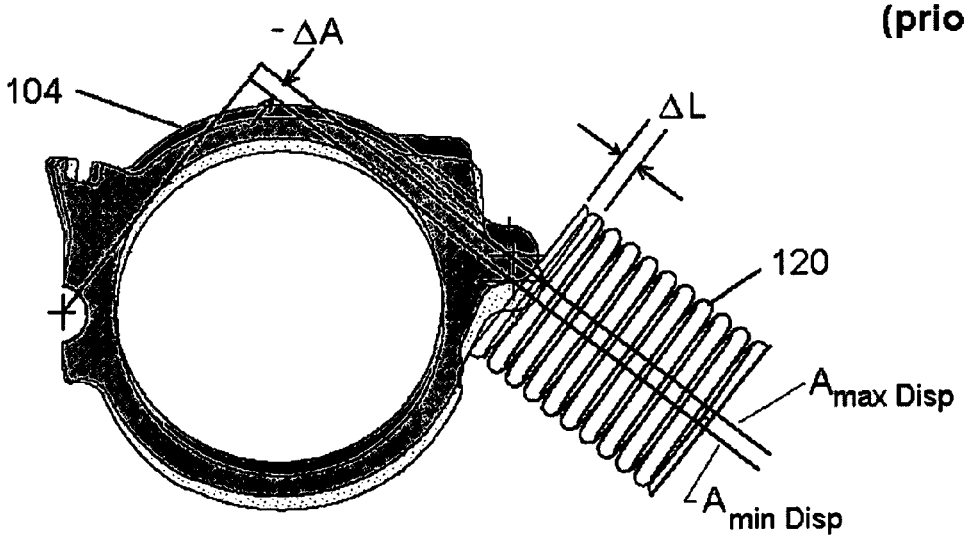
FIG. 5 a graphical representation of the change in length of the moment arm and the change in length of the control spring between the maximum displacement position and the minimum displacement position of the pump of FIG. 3.

FIGS. 4 and 5 illustrate graphically the improvements obtained with the present invention. In FIGS. 4 and 5, the respective control rings 24 and 104 have undergone the same amount of movement between their maximum and minimum positions.

FIG. 4 shows the maximum displacement position (indicated in solid shading) and the minimum displacement position (indicated in stipled shading) of control ring 24. As illustrated, control spring 40 is subject to a change in length of $\Delta L_{pa}$ and the moment arm A increases by the amount +ΔA, as control ring 24 moves from the maximum displacement position to the minimum displacement position.

FIG. 5 shows the maximum displacement position (indicated in solid shading) and the minimum displacement position (indicated in stipled shading) of control ring 104. As illustrated, control spring 120 is subject to a change in length of ΔL, where ΔL is less than $\Delta L_{pa}$, and the moment arm A decreases by the amount −ΔA, as control ring 104 moves from the maximum displacement position to the minimum displacement position.

As discussed above, the moment M about the pivot point a control ring is equal to $$M=A*\Delta L*k_s$$

and the present invention provides advantages over the prior art in that ΔL is reduced in comparison to equivalent prior art variable displacement vane pumps. Further, and perhaps more significantly, with the present invention the moment arm A does not increase as the control ring is moved from the maximum displacement position to the minimum displacement position. In fact, with the present invention moment arm A decreases as the control ring moves from the maximum displacement position to the minimum displacement position and this decrease can offset, in whole or in part, the increase in the spring force due to the inevitable change in the length (ΔL) of the control spring.

While the specific geometry of a pump in accordance with the present invention will depend upon many different factors, the present inventors have determined that the benefits of the present invention can be obtained when the longitudinal axis 142 of the control spring is at an angle θ with respect to plane 140. In one aspect of the invention, when θ is measured with control ring 104 in the maximum displacement position, θ can range from about ten degrees to about eighty degrees. More preferably, θ can range from about twenty-five degrees to about sixty-five degrees. Still more preferably, θ can range from about thirty-five degrees to about fifty-five degrees. Still more preferably, θ can range from about forty degrees to about fifty degrees.

Figure 6:
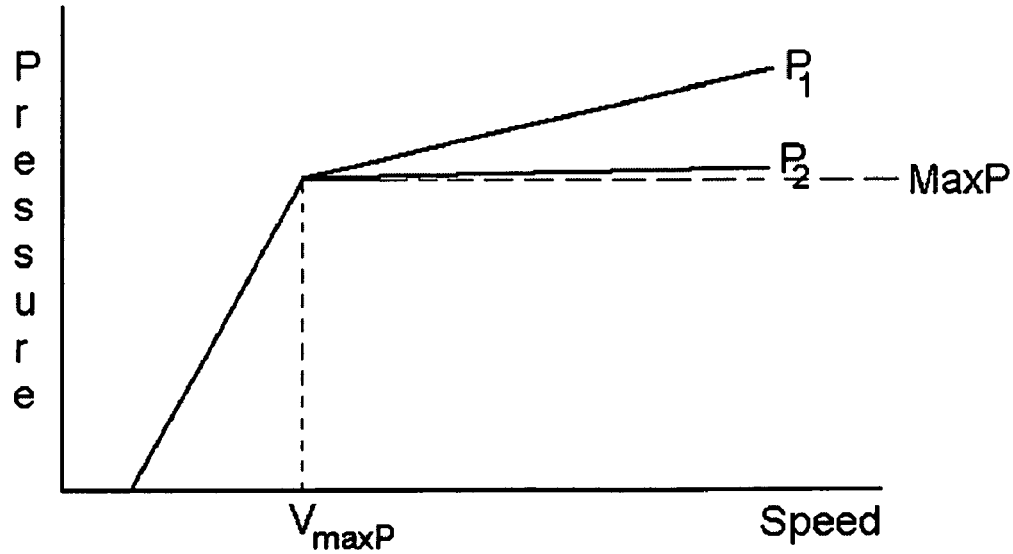
FIG. 6 shows a comparison of the output versus operating speed characteristics of the prior art pump of FIG. 1 and the pump of FIG. 3.

FIG. 6 shows a comparison of the output pressure versus speed operating characteristics of prior art pump 20, curve $P_1$, and the output pressure versus speed operating characteristics of pump 100, curve $P_2$, of the present invention versus the maximum desired pressure MaxP for a given internal combustion engine. As can be clearly seen, the output pressure $P_2$ of pump 100 is substantially constant in its regulated operating region, which can result in a significant energy savings in the operation of the internal combustion engine.

The present invention provides a variable displacement vane pump which is able to achieve a substantially constant output pressure in its regulated operation region. The longitudinal axis of the control spring of the pump is inclined, with respect to a plane through the rotational axis about which the control ring pivots and the contact point between the control spring and the control ring, and this inclination results in a reduction in the length of the moment arm between the spring and the pivot when the control ring of the pump is moved from the maximum displacement position to the minimum displacement position. By reducing the length of this moment arm, the increase in the moment produced by compression of the control spring is offset, resulting in a substantially constant output pressure in the regulated operating range of the pump. Further, the inclination can result in a reduction of the amount by which the control spring is compressed when the control ring moves from the first position to the second position.

The above-described embodiments of the invention are intended to be examples of the present invention and alterations and modifications may be effected thereto, by those of skill in the art, without departing from the scope of the invention which is defined solely by the claims appended hereto.

We claim:

1. A variable displacement vane pump, comprising:

a control ring pivotable between a first position wherein the pump has a maximum displacement and a second position wherein the pump has a minimum displacement;

a feedback mechanism responsive to the output pressure of the pump to move the control ring from the first position towards the second position in response to increases in the output pressure of the pump; and a control spring biasing the control ring towards the first position, the longitudinal axis of the control spring being inclined at a swept angle of from ten degrees to fifty-five degrees initiating at and with respect to a plane passing through the rotational axis about which the control ring pivots and the contact point between the control ring and the control spring.

2. A variable displacement pump according to claim 1 wherein the longitudinal axis of the control spring being inclined at an angle of from about thirty-five degrees to fifty-five degrees when the control ring is in the first position.

3. A variable displacement pump according to claim 1 wherein the longitudinal axis of the control spring being inclined at an angle of from about forty degrees to about fifty degrees when the control ring is in the first position.

4. A variable displacement pump according to claim 1 wherein the control spring engages the control ring through a protrusion on the control ring, the protrusion having a curved surface allowing the protrusion to move across an end of the control spring.

5. A variable displacement pump according to claim 1 further comprising a spring cap over an end of the control spring, the spring cap engaging a protrusion on the control ring, the protrusion having a curved surface allowing the protrusion to move across the spring cap.

6. A variable displacement pump according to claim 1 further comprising a spring cap over an end of the control spring, the spring cap engaging a protrusion on the control ring, and one of the protrusion and spring cap having a bearing surface allowing the protrusion to move across the spring cap.

7. A variable displacement vane pump operable to provide a substantially constant output, independent of pump operating speed increases, when the pump is in its regulated operating region, the pump comprising:

a control ring pivotable between a first position wherein the pump has a maximum displacement and a second position wherein the pump has a minimum displacement;

a feedback mechanism responsive to the output pressure of the pump to move the control ring from the first position towards the second position in response to increases in the output pressure of the pump; and a control spring biasing the control ring towards the first position, wherein the control spring is oriented with respect to a plane extending through the rotational axis about which the control ring pivots and the contact point between the control ring and the spring, such that the moment arm of the control spring force about the point where the control ring pivots decreases as the control ring pivots towards the second position.

* * * * *